US005686823A

United States Patent [19]

Rapp

[11] Patent Number: 5,686,823

[45] Date of Patent: Nov. 11, 1997

[54] BANDGAP VOLTAGE REFERENCE CIRCUIT

[75] Inventor: A. Karl Rapp, Los Gatos, Calif.

[73] Assignee: National Semiconductor Corporation, Santa Clara, Calif.

[21] Appl. No.: 689,311

[22] Filed: Aug. 7, 1996

[51] Int. Cl.[6] ..... G05F 3/26

[52] U.S. Cl. ..... 323/313; 323/315

[58] Field of Search ..... 323/313, 314, 323/315, 316, 312, 281; 327/530, 538, 539

[56] References Cited

U.S. PATENT DOCUMENTS

| | | | |
|---|---|---|---|
| 4,151,482 | 4/1979 | Robe | 330/308 |
| 4,251,743 | 2/1981 | Hareyama | 307/297 |
| 4,287,439 | 9/1981 | Leuschner | 307/310 |
| 4,399,398 | 8/1983 | Wittlinger | 323/226 |
| 4,447,784 | 5/1984 | Dobkin | 323/226 |
| 4,628,248 | 12/1986 | Birritella et al. | 323/314 |
| 4,656,374 | 4/1987 | Rapp | 307/475 |
| 4,816,742 | 3/1989 | van de Plaasche | 323/314 |
| 4,839,535 | 6/1989 | Miller | 307/296.7 |
| 4,849,684 | 7/1989 | Sonntag et al. | 323/313 |
| 4,896,094 | 1/1990 | Greaves et al. | 323/314 |
| 4,924,113 | 5/1990 | Schade, Jr. | 307/296.6 |
| 4,935,690 | 6/1990 | Yan | 323/314 |
| 4,939,442 | 7/1990 | Carvajal et al. | 323/281 |
| 4,977,336 | 12/1990 | Martiny | 307/290 |
| 5,038,055 | 8/1991 | Kinoshita | 307/351 |
| 5,063,342 | 11/1991 | Hughes et al. | 323/315 |
| 5,084,665 | 1/1992 | Dixon et al. | 323/281 |
| 5,087,831 | 2/1992 | Ten Eyck | 307/296.6 |
| 5,089,769 | 2/1992 | Petty et al. | 323/316 |
| 5,160,882 | 11/1992 | Ten Eyck | 323/314 |
| 5,221,864 | 6/1993 | Galbi et al. | 307/296.8 |
| 5,229,710 | 7/1993 | Kraus et al. | 323/313 |
| 5,245,273 | 9/1993 | Greaves et al. | 323/313 |
| 5,289,111 | 2/1994 | Tsuji | 323/314 |
| 5,291,122 | 3/1994 | Audy | 323/313 |
| 5,453,679 | 9/1995 | Rapp | 323/313 |
| 5,559,425 | 9/1996 | Allman | 323/315 |
| 5,592,123 | 1/1997 | Ulbrich | 330/288 |
| 5,612,613 | 3/1997 | Dutt | 323/314 |

FOREIGN PATENT DOCUMENTS

| | | | |
|---|---|---|---|
| 0 415 620 A2 | 3/1991 | European Pat. Off. | H03F 3/45 |

OTHER PUBLICATIONS

M.A. Rybicki, "A Push–Pull Transconductance Amplifier with Extended Power Supply and Common Mode Range", Motorola Technical Developments, Aug. 1989, pp. 58–59.

Chung–Yu Wu et al., "New Fully Differential HF CMOS OP Amp's With Efficient Common Mode Feedback", 1989 IEEE International Symposium on Circuits and Systems, vol. 3 of 3, May 1989, pp. 2076–2079.

J. Fisher et al., "A Highly Linear CMOS Buffer Amplifier", IEEE Journal of Solid–State Circuits, vol. SC–22, No. 3, Jun. 1987, pp. 330–334.

D. Senderowicz et al., "PCM Telephony: Reduced Architecture for a D/A Converter and Filter Combination", IEEE Journal of Solid–State Cirucits, 25, (1990) Aug., No. 4, pp. 987–995.

*Primary Examiner*—Adolf Berhane

*Attorney, Agent, or Firm*—Limbach & Limbach L.L.P.

[57] ABSTRACT

A bandgap voltage reference circuit includes a feedback controlled current mirror, a bandgap voltage generator, and a voltage comparator. The current mirror, in response to a feedback control signal from the voltage comparator, generates a controllable reference current. The bandgap voltage generator generates two reference voltages based upon conduction of the reference current from the current mirror through two PN diodes having different emitter areas. The voltage comparator compares the two reference voltages and generates the feedback control signal for the current mirror. Such a bandgap voltage reference circuit simultaneously generates a bandgap voltage reference and a current mirror reference while also being operable over a wide power supply voltage range and down to very low power supply voltage values.

18 Claims, 3 Drawing Sheets

BANDGAP VOLTAGE REFERENCE CIRCUIT

BACKGROUND OF THE INVENTION

1. Field of the Invention

The present invention relates to a bandgap voltage reference generator circuit which operates over a wide supply voltage range and consumes little supply current.

2. Description of the Related Art

Bandgap voltage references are well known for obtaining a reference voltage that is relatively constant over a substantial temperature range. The basic concept is to combine two potentials, one having a positive temperature coefficient and one having a negative temperature coefficient. The sum of these two potentials is made equal to the semiconductor bandgap potential extrapolated to absolute zero temperature. For silicon, this value is close to 1.2 volts.

Typically, the negative temperature coefficient potential is obtained from a forward-biased PN junction, i.e., the emitter-base junction in a conducting transistor operated at a current that will produce a voltage drop of about 600 mV at 300° K. This voltage has a negative temperature coefficient of about 2 mV/°C. The positive temperature coefficient is obtained from a $\Delta V_{BE}$-producing circuit that develops a 600 mV potential at about 300° K. This voltage has a positive temperature coefficient of about 2 mV/°C. Thus, when these two voltages are combined at 300° K, a 1.2 V potential is produced with close to zero temperature coefficient.

The $\Delta V_{BE}$ potential is typically produced by operating a pair of transistors or diodes at substantially different current densities. This can be done by ratioing the transistor or diode areas and passing equal currents, or by using matched area devices and ratioing the currents. If desired, a combination of transistor size and current ratioing can be employed. The low-current-density transistor includes a series resistor. The two devices are equivalently connected in parallel so that the differential voltage drop ($\Delta V_{BE}$) appears across the resistor. Typically, at 300° K and a current-density ratio of 10, the $\Delta V_{BE}$ will be about 60 mV. This value, when multiplied by 10, produces a voltage of about 600 mV having a positive temperature coefficient.

SUMMARY OF THE INVENTION

A bandgap voltage generator in accordance with the present invention provides a highly stable temperature-constant bandgap voltage reference circuit that simultaneously generates a bandgap voltage reference and a current mirror reference and operates over a wide power supply voltage range and down to very low power supply voltage values.

In accordance with one embodiment of the present invention, a bandgap voltage generator includes a current source, a current amplifier, a voltage generator and a voltage comparator. The current source is configured to receive a control signal and in accordance therewith provide an input current which is adjustable in accordance with the control signal. The current amplifier is coupled to the current source and is configured to conduct the input current and in accordance therewith conduct an output current which is proportional to the input current. The voltage generator is coupled to the current amplifier, includes first and second PN junction devices having first and second current densities, and is configured to receive the output current and in accordance therewith generate first and second voltages. The first and second voltages are approximately proportional to the output current and are dependent upon the first and second current densities, respectively. The voltage comparator is coupled to the voltage generator and the current source and is configured to receive and compare the first and second voltages and in accordance therewith provide the control signal such that the first and second voltages are equal.

In accordance with another embodiment of the present invention, a bandgap voltage generator includes a reference voltage generator, a voltage converter and a voltage comparator. The reference voltage generator includes a controllable shunt circuit which is configured to receive a control signal, generate a shunt current which is adjustable in accordance with the control signal and generate a reference voltage which is adjustable in accordance with the shunt current. The voltage converter is coupled to the reference voltage generator, includes first and second PN junction devices having first and second current densities, and is configured to receive the reference voltage and generate first and second voltages which are dependent upon the first and second current densities, respectively, and are adjustable in accordance with the reference voltage. The voltage comparator is coupled to the voltage converter and the reference voltage generator and is configured to receive and compare the first and second voltages and in accordance therewith provide the control signal such that the first and second voltages are equal.

These and other features and advantages of the present invention will be understood upon consideration of the following detailed description of the invention and the accompanying drawings.

DETAILED DESCRIPTION OF THE INVENTION

To aid explanation and understanding, where components are similar between figures, the same identifying label has been used. Where components of different diagrams perform similar functions, but vary in dimensions, they are identified with the number of the figure as the most significant digit and with identical least significant digits in the identifying label.

Figure 1:
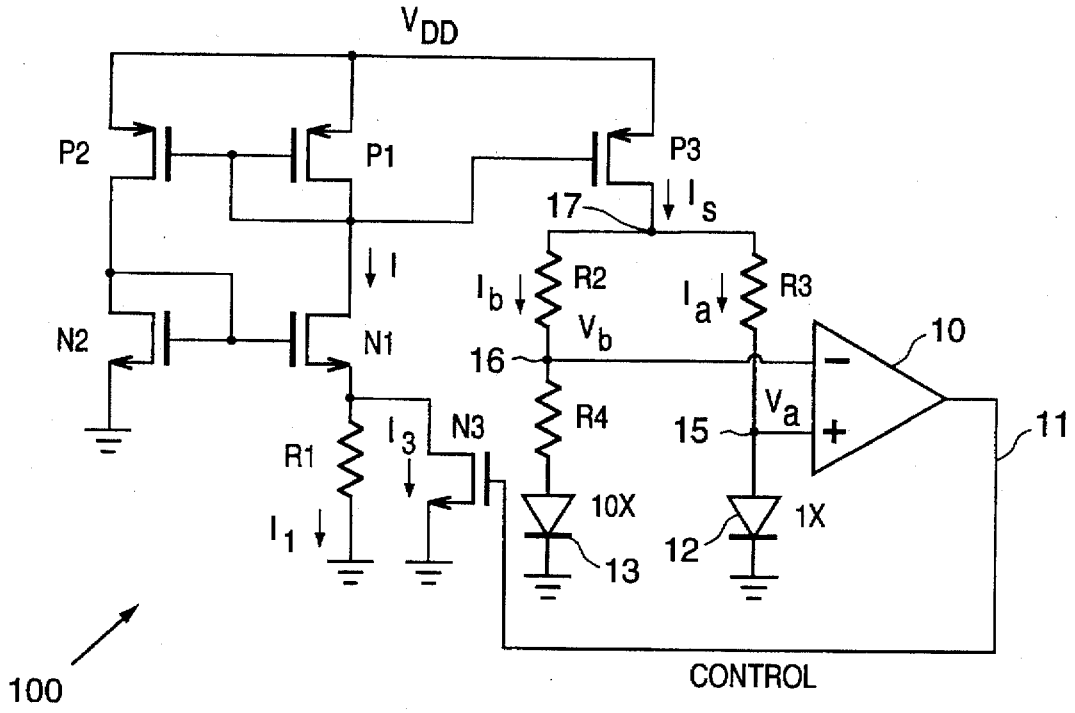
FIG. 1 is a simplified schematic showing the high gain feedback loop for a bandgap voltage reference circuit in accordance with the present invention and which includes a current reference circuit.

FIG. 1 illustrates a simplified schematic diagram of the $\Delta V_{BE}$ portion of a bandgap voltage reference circuit 100 with a high gain feedback loop driven by a voltage output comparator 10 in accordance with the present invention. In the FIG. 1 circuit, the currents $I_a$ and $I_b$ flow in PN diodes 12 and 13, respectively. As shown in FIG. 1, the emitter area of diode 13 is 10 times that of diode 12. Voltage $V_a$ is developed across diode 12 and appears at circuit node 15. Voltage $V_b$ is developed across the series combination of diode 13 and resistor R4 so that this voltage appears at circuit node 16. Resistors R2 and R3 function primarily to determine the levels of currents $I_b$ and Ia, respectively, which, in the preferred embodiment of the invention, are made equal. As shown in FIG. 1, and described in detail below, and in accordance with the present invention, a voltage output comparator 10 has its differential inputs connected to nodes 15 and 16 and its voltage output 11 connected to control the current input $I_s$ shown in FIG. 1.

In FIG. 1, a current reference circuit made up of p-channel reference transistor P1, p-channel current mirror transistor P2, n-channel current reference transistor N1, n-channel current mirror transistor N2, and current reference circuit resistor R1 establish a reference current I. The reference current I in transistor P1 is mirrored and ratioed in p-channel current mirror transistor P3 to control current $I_s$ which is the current source for the resistor and divider network of the bandgap voltage reference circuit. Resistor R1 is sized such that the reference current I established by the current reference circuit is insufficient to achieve balance between voltages $V_a$ and $V_b$, at circuit nodes 15 and 16 respectively, which are input to voltage output comparator 10.

The comparator 10 monitors the voltages $V_a$ and $V_b$ in the bandgap circuit and generates feedback control signal 11 which controls the conductance of a current shunt transistor N3. Transistor N3, in turn, produces a current $I_3$ which shunts the resistor R1 in the current reference. By varying the magnitude of $I_3$, the current in transistor P1 and the mirror current $I_s$ in transistor P3 can be modified which controls the currents $I_a$ and $I_b$ in the two branches of the bandgap voltage reference. The voltages $V_a$ and $V_b$ vary in response to currents $I_a$ and $I_b$, respectively, to complete the feedback loop. The feedback causes the shunt transistor N3 to conduct the correct amount of current to balance voltages $V_a$ and $V_b$ at the inputs to comparator 10. The high sensitivity of the shunt transistor N3 to the voltage output 11 from comparator 10 gives the feedback loop very high gain.

Figure 2:
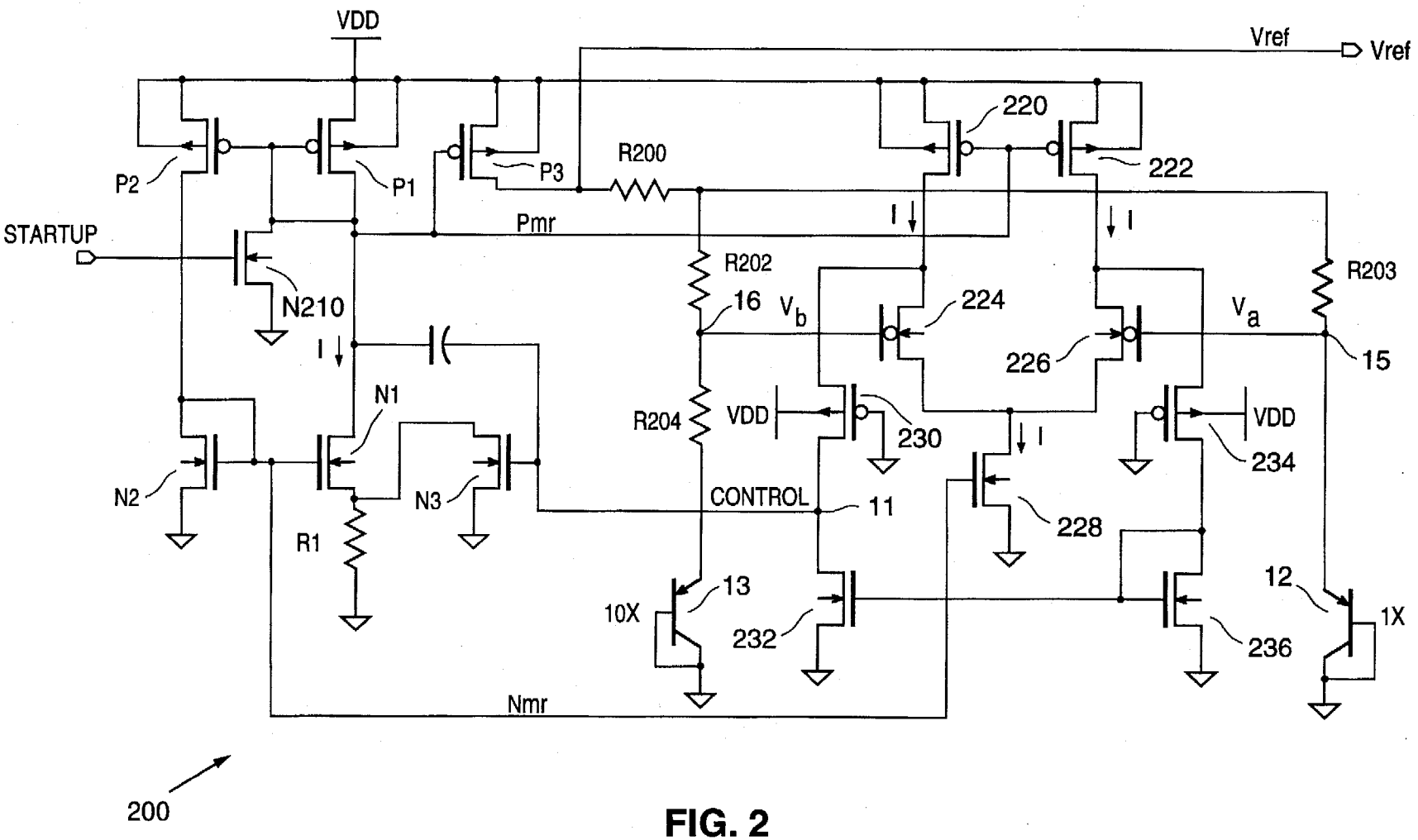
FIG. 2 is a schematic diagram illustrating a CMOS version of a bandgap voltage reference with a high gain feedback loop in accordance with the present invention and which shows a low-power voltage output comparator.

The schematic for an embodiment of the bandgap voltage reference circuit 100 is shown in FIG. 2. In this circuit, the resistors R2, R3 and R4 in the bandgap branches are formed by four smaller resistors R200, R202, R203 and R204 to save die area. A startup transistor N210 is shown that is driven by a Startup signal to ensure that current flow is established in the current reference circuit. Diode 13 is fabricated as a plurality of ten diode-connected transistors of the same size as diode-connected transistor 12 connected in parallel to produce the equivalent of a large diode with a PN junction area ten times that of diode-connected transistor 12.

An embodiment of the voltage comparator 10 is also shown in FIG. 2. Input transistors 224 and 226 are native devices connected together at their sources and also to the drain of current mirror transistor 228. Current mirror transistor 228 has its gate connected to an n-channel current reference voltage Nmr which is obtained from the current reference circuit, as shown here, or from an external current reference, as described below. The input transistors 224 and 226 are connected to load transistors 220 and 222 respectively. The load transistors 220 and 222 are driven by p-channel current reference voltage Pmr which is obtained from the current reference circuit, as shown here, or from an external current reference.

Branching off from the drain of each input transistor 224 and 226 is a clamped-active p-channel transistor (230 and 234, respectively) in series with an n-channel transistor (232 and 236, respectively). The clamped-active transistors 230 and 234 each have their gate connected to the ground potential and function to maintain the input transistors in their active region by preventing the drain voltage of the input transistors from falling below one p-channel threshold voltage. N-channel transistor 236 is diode connected and connected to the gate of transistor 232 which will consequently mirror the current in transistor 236.

At balance, the current reference voltages will induce a current of magnitude I in transistor 228 and in each of load transistors 220 and 222. Because transistor 228 can only sink current I, the remaining current sourced by load transistors 220 and 222 must be sunk by the branch legs off of each input transistor 224 and 226. With the circuit at balance, I/2 flows through the branch leg including clamped-active transistor 234 and diode connected transistor 236. Current mirror transistor 232 mirrors the current in transistor 236 so that I/2 flows in clamped-active transistor 230 and transistor 232.

When the voltages $V_a$ and $V_b$ are not balanced, then the resulting difference in input voltage to transistors 224 and 226 alters the currents in the branch legs to produce an output voltage signal 11 at the drain of transistor 232. For example, when $V_b$ is greater than $V_a$, input transistor 224 conducts more current than input transistor 226. Because current sink transistor 228 maintains a constant current level, the additional current passing through transistor 24 must be counterbalanced by reduced current flow in input transistor 226. The reduction in current through input transistor 226 results in more current flowing into transistor 234 and diode connected transistor 236. The current in transistor 236 is mirrored by transistor 232 which is driven harder while, simultaneously, there is less current flowing through transistor 230 because of the additional current drawn by input transistor 224. The consequence is that the output voltage 11 at the drains of transistors 230 and 232 drops in proportion to the amount by which $V_b$ exceeds $V_a$.

Conversely, when $V_a$ is greater than $V_b$, the relationship between the relative currents in the branch legs of the comparator is reversed. Input transistor 224 conducts less current resulting in more current flowing through input transistor 226. As a consequence, less current flows in transistor 234 and diode connected transistor 236 resulting in less current draw in mirror transistor 232. At the same time, because input transistor 224 is conducting less current, more current is available through transistor 230 and the output voltage 11 rises in proportion to the difference between $V_a$ and $V_b$.

The circuit nodes 15 and 16 of the bandgap voltage reference are connected to the input transistors 224 and 226 of the voltage comparator. The voltage output control signal 11 of the comparator drives the gate of shunt transistor N3 to control the current in transistor N1 and, consequently, also the current in transistor P3 to form the high gain feedback loop described above. The signal $V_{ref}$ is the stable voltage reference level generated by the circuit 200.

The circuit of FIG. 2 may be formed using CMOS technology employing the following components:

| Component | Value/Size (W/L in Microns) |
|---|---|
| Resistor R1 | 50 K ohms |
| Resistor R200 | 22 K ohms |
| Resistors R202 and R203 | 44 K ohms |
| Resistor R204 | 10 K ohms |
| Transistor N1 | 20/5 |
| Transistors 224, 226 | 25/5 |
| Transistors N2, P1, P2, 220, 222, 228 | 10/5 |
| Transistors 230, 234 | 3/1 |
| Transistor N3 | 5/2 |
| Transistors 232, 236 | 5/5 |
| Transistor 210 | 3/5 |
| Transistor P3 | 50/5 |

Transistors 224 and 226 are constructed to have low (about 0.2 volt) thresholds. The nominal operating power supply voltage range is 1.5–6.0 volts. When the circuit is stable (i.e., balance is achieved), the current in transistor P3 is 12 microamperes. Hence, the current "I" in transistor P1 is 2.4 microamperes (i.e., 10/50 of 12 microamperes).

Figure 3:
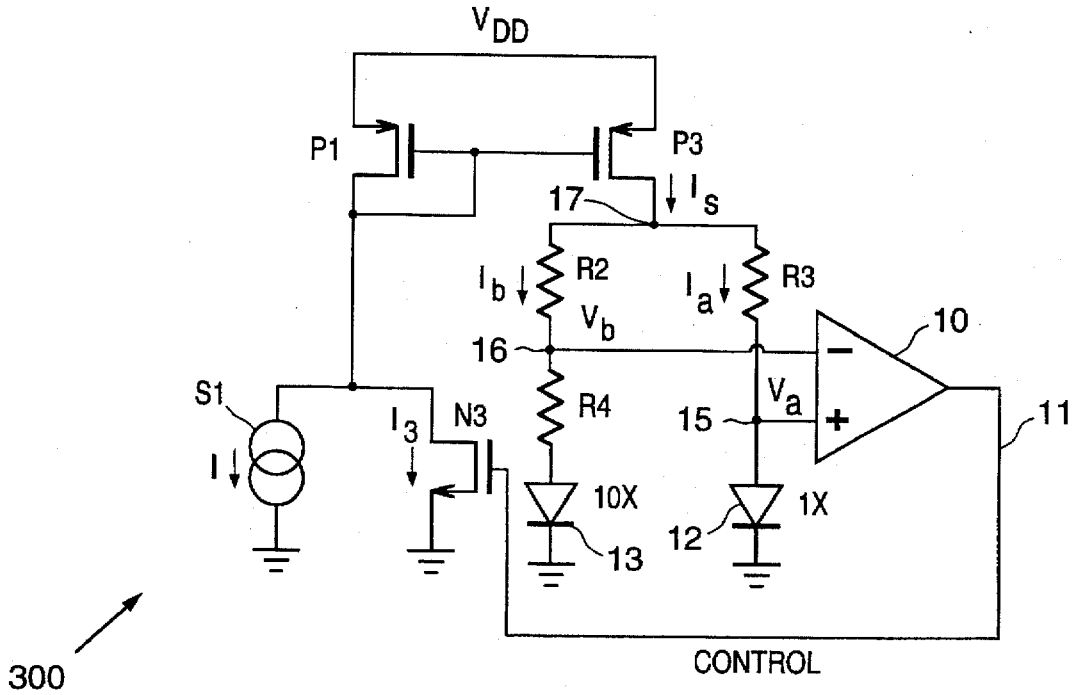
FIG. 3 is a simplified schematic diagram illustrating another embodiment of a bandgap reference circuit with a high gain feedback loop in accordance with the present invention which is shown with current reference signals supplied by a current reference external to the bandgap voltage reference circuit.

In FIG. 3, a simplified schematic of a bandgap voltage reference circuit 300 with an externally controlled current source S1 is shown. When current reference voltages are available from an external source, then the reference circuit 300 may be employed which is simplified version of the bandgap voltage reference circuit 100 of FIGS. 1 and 2 and requires no startup signal.

The current sink S1 sinks a current I which, as was the case above, induces current $I_s$ in transistor P3 that is less than the current necessary to balance voltages $V_a$ and $V_b$ in the two legs of the bandgap reference circuit. Voltages $V_a$ and $V_b$ are input to comparator 10 which produces voltage output control 11 that drives shunt transistor N3 in order to vary the current $I_3$ and thereby form the high gain feedback loop discussed above.

Figure 4:
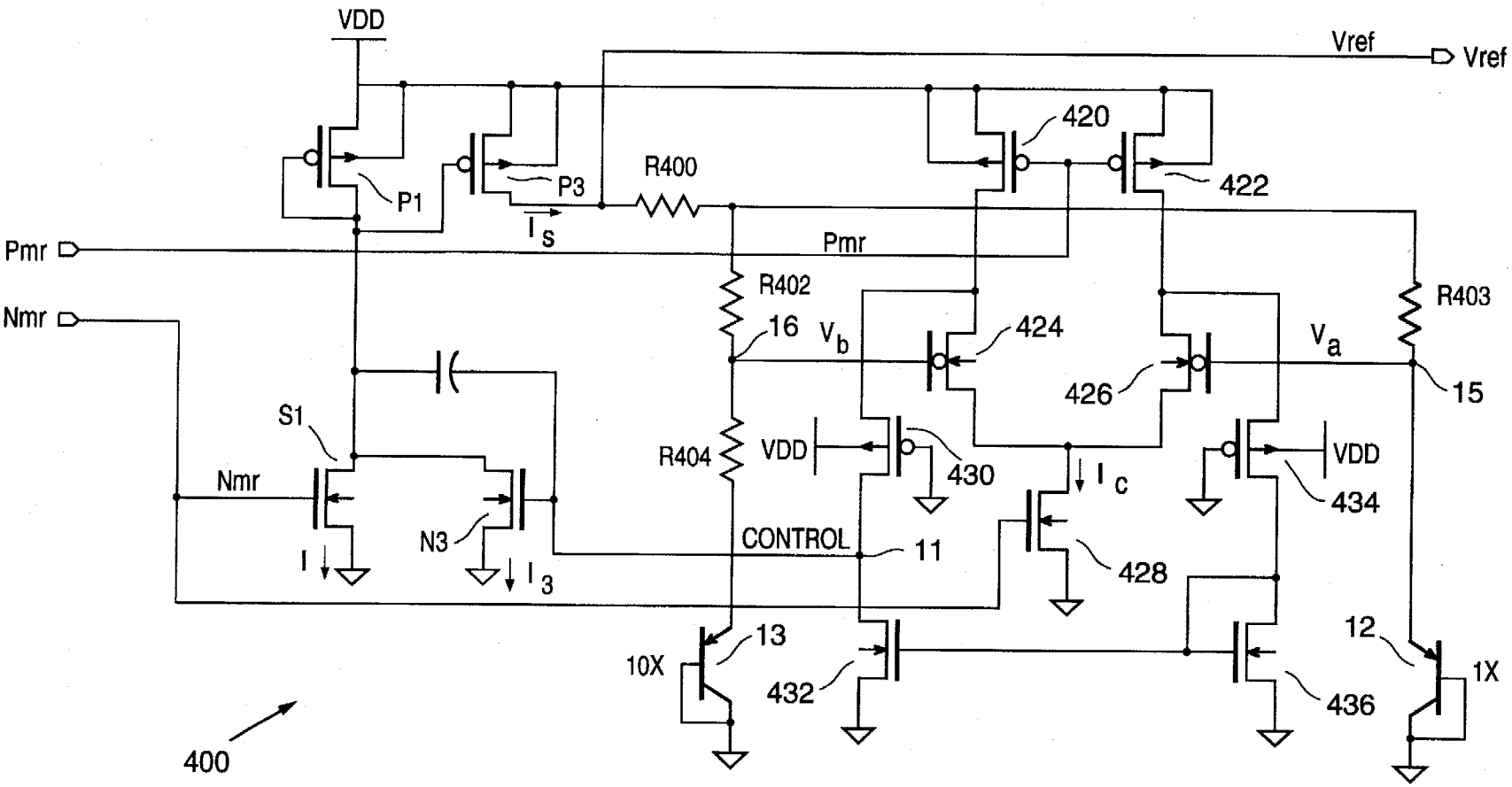
FIG. 4 is a schematic diagram illustrating another embodiment of a bandgap voltage reference circuit with a high gain feedback loop in accordance with the present invention which is shown with current reference signals supplied by a current reference external to the bandgap voltage reference circuit and which shows a low-power voltage output comparator.

FIG. 4 is a detailed schematic of a bandgap voltage reference 400 which implements the design of FIG. 3. The current source S1 is driven by externally supplied n-channel current reference signal Nmr which also drives current sink transistor 428 in the voltage comparator circuit. Similarly, externally supplied p-channel current reference signal Pmr drives load transistor 420 and 422 that source constant currents in the two branches of the voltage comparator circuit. The current I in current sink S1 combines with the current $I_3$ in shunt transistor N3 to determine the current in transistor P1 and, consequently, control the current $I_s$ supplied to the two branches of the bandgap voltage reference circuit by transistor P3 and which ultimately determines the level of the voltage $V_a$ and $V_b$ input to the comparator. The current $I_3$ in shunt transistor N3 is controlled by the voltage output control signal 11 from the comparator circuit to form the high gain feedback loop that controls the bandgap voltage circuit 400. The output signal $V_{ref}$ is the stable voltage reference output generated by the circuit 400.

The circuit of FIG. 4 may be formed using CMOS technology employing the following components:

| Component | Value/Size (W/L in Microns) |
|---|---|
| Resistor R400 | 22 K ohms |
| Resistors R402 and R403 | 44 K ohms |
| Resistor R404 | 10 K ohms |
| Transistor S1 | 5/10 |
| Transistors 424, 426 | 25/5 |
| Transistor P1 | 10/5 |

-continued

| Component | Value/Size (W/L in Microns) |
|---|---|
| Transistors 430, 434 | 3/1 |
| Transistor N3 | 5/2 |
| Transistors 420, 422, 428, 432, 436 | 5/5 |
| Transistor P3 | 100/5 |

Transistors 424 and 426 are constructed to have low (about 0.2 volt) thresholds. The nominal operating power supply voltage range and current are 1.5–6.0 volts and 15.2 microamperes, respectively. When the circuit is stable (i.e., balance is achieved), the current in transistor P3 is 12 microamperes. Hence, the current in transistor P1 (i.e., the sum of currents "I" and "$I_3$" in transistors S1 and N3, respectively) is 1.2 microamperes (i.e., 10/100 of 12 microamperes).

It should be understood that various alternatives to the embodiments of the invention described herein may be employed in practicing the invention. It is intended that the following claims define the scope of the invention and that methods and circuits within the scope of these claims and their equivalents be covered thereby.

What is claimed is:

1. An apparatus including a bandgap voltage generator comprising:

a current source configured to receive a control signal and in accordance therewith provide an input current which is adjustable in accordance with said control signal, wherein said current source includes a current shunt configured to be coupled across a current conductor and receive said control signal, and wherein said current conductor conducts a series current, said current shunt conducts a shunt current in accordance with said control signal and said input current comprises a sum of said series current and said shunt current;

a current amplifier, coupled to said current source, configured to conduct said input current and in accordance therewith conduct an output current which is proportional to said input current;

a voltage generator, coupled to said current amplifier, including first and second PN junction devices having first and second current densities, and configured to receive said output current and in accordance therewith generate first and second voltages, wherein said first and second voltages are approximately proportional to said output current and are dependent upon said first and second current densities, respectively; and a voltage comparator, coupled to said voltage generator and said current source, configured to receive and compare said first and second voltages and in accordance therewith provide said control signal such that said first and second voltages are equal.

2. The apparatus of claim 1, further comprising a resistor as said current conductor.

3. The apparatus of claim 1, wherein said current amplifier comprises a current mirror.

4. The apparatus of claim 1, wherein said voltage generator comprises:

a first circuit branch including said first PN junction device and first and second resistors serially coupled thereto; and a second circuit branch including said second PN junction device and a third resistor serially coupled thereto.

5. The apparatus of claim 4, wherein said first voltage is generated across said first PN junction device and said first resistor and said second voltage is generated across said second PN junction device.

6. An apparatus including a bandgap voltage generator comprising:

a reference voltage generator including a controllable shunt circuit configured to receive a control signal, generate a shunt current which is adjustable in accordance with said control signal and generate a reference voltage which is adjustable in accordance with said shunt current;

a voltage converter, coupled to said reference voltage generator, including first and second PN junction devices having first and second current densities, and configured to receive said reference voltage and generate first and second voltages which are dependent upon said first and second current densities, respectively, and are adjustable in accordance with said reference voltage; and a voltage comparator, coupled to said voltage converter and said reference voltage generator, configured to receive and compare said first and second voltages and in accordance therewith provide said control signal such that said first and second voltages are equal.

7. The apparatus of claim 6, wherein said reference voltage generator comprises a current shunt configured to be coupled across a current conductor and receive said control signal, wherein said current conductor conducts a series current, said current shunt conducts a shunt current in accordance with said control signal and said input current comprises a sum of said series current and said shunt current and said reference voltage is generated in accordance with said input current.

8. The apparatus of claim 6, wherein said reference voltage generator comprises:

a resistor configured to conduct a series current; and a current shunting device, coupled across said resistor, configured to receive said control signal and in accordance therewith conduct a shunt current;

wherein said input current comprises a sum of said series current and said shunt current and said reference voltage is generated in accordance with said input current.

9. The apparatus of claim 6, wherein said voltage generator comprises:

a first circuit branch including said first PN junction device and first and second resistors serially coupled thereto; and a second circuit branch including said second PN junction device and a third resistor serially coupled thereto.

10. The apparatus of claim 9, wherein said first voltage is generated across said first PN junction device and said first resistor and said second voltage is generated across said second PN junction device.

11. A method of generating a bandgap voltage, said method comprising the steps of:

receiving a control signal and in accordance therewith generating an input current which is adjustable in accordance with said control signal by conducting a series current with a current conductor, and coupling across said current conductor and receiving a control signal and in accordance therewith conducting a shunt current, wherein said input current comprises a sum of said series current and said shunt current;

conducting said input current and in accordance therewith conducting an output current which is proportional to said input current;

receiving said output current with first and second PN junction devices having first and second current densities and in accordance therewith generating first and second voltages which are approximately proportional to said output current and are dependent upon said first and second current densities, respectively; and receiving and comparing said first and second voltages and in accordance therewith generating said control signal such that said first and second voltages are equal.

12. The method of claim 11, wherein said step of conducting said input current and in accordance therewith conducting an output current which is proportional to said input current comprises receiving said input current and generating said output current with a current mirror.

13. The method of claim 11, wherein said step of receiving said output current with first and second PN junction devices having first and second current densities and in accordance therewith generating first and second voltages which are approximately proportional to said output current and are dependent upon said first and second current densities, respectively, comprises:

receiving a portion of said output current with a first circuit branch including said first PN junction device and first and second resistors serially coupled thereto; and receiving another portion of said output current with a second circuit branch including said second PN junction device and a third resistor serially coupled thereto.

14. The method of claim 13, wherein said step of receiving said output current with first and second PN junction devices having first and second current densities and in accordance therewith generating first and second voltages which are approximately proportional to said output current and are dependent upon said first and second current densities, respectively, comprises generating said first voltage across said first PN junction device and said first resistor and generating said second voltage across said second PN junction device.

15. A method of generating a bandgap voltage, said method comprising the steps of:

receiving a control signal with a controllable shunt circuit and generating therewith a shunt current which is adjustable in accordance with said control signal;

generating a reference voltage which is adjustable in accordance with said shunt current;

receiving said reference voltage with a circuit which includes first and second PN junction devices having first and second current densities and in accordance therewith generating first and second voltages which are dependent upon said first and second current densities, respectively, and are adjustable in accordance with said reference voltage; and receiving and comparing said first and second voltages and in accordance therewith generating said control signal such that said first and second voltages are equal.

16. The method of claim 15, wherein said step of receiving a control signal with a controllable shunt circuit and generating therewith a shunt current which is adjustable in accordance with said control signal comprises:

conducting a series current with a current conductor; and coupling across said current conductor and receiving said control signal and in accordance therewith conducting a shunt current, wherein said input current comprises a sum of said series current and said shunt current and said reference voltage is generated in accordance with said input current.

17. The method of claim 15, wherein said step of receiving said reference voltage with a circuit which includes first and second PN junction devices having first and second current densities and in accordance therewith generating first and second voltages which are dependent upon said first and second current densities, respectively, and are adjustable in accordance with said reference voltage comprises:

receiving said reference voltage and in accordance therewith generating an output current;

receiving a portion of said output current with a first circuit branch including said first PN junction device and first and second resistors serially coupled thereto; and receiving another portion of said output current with a second circuit branch including said second PN junction device and a third resistor serially coupled thereto.

18. The method of claim 15, wherein said step of receiving said reference voltage with a circuit which includes first and second PN junction devices having first and second current densities and in accordance therewith generating first and second voltages which are dependent upon said first and second current densities, respectively, and are adjustable in accordance with said reference voltage comprises generating said first voltage across said first PN junction device and said first resistor and generating said second voltage across said second PN junction device.

* * * * *